US005758774A

United States Patent [19]

Leblong

[11] Patent Number: 5,758,774

[45] Date of Patent: Jun. 2, 1998

[54] CONVERTIBLE CHILD-RESISTANT BLISTER PACKAGE

[75] Inventor: Wayne T. Leblong, Kalamazoo, Mich.

[73] Assignee: Pharmacia & Upjohn Company, Kalamazoo, Mich.

[21] Appl. No.: 766,000

[22] PCT Filed: Jun. 28, 1995

[86] PCT No.: PCT/US95/07863

§ 371 Date: Jan. 27, 1997

§ 102(e) Date: Jan. 27, 1997

[87] PCT Pub. No.: WO96/03329

PCT Pub. Date: Feb. 8, 1996

Related U.S. Application Data

[63] Continuation of Ser. No. 280,496, Jul. 26, 1994, abandoned.

[51] Int. Cl.[6] ..... B65D 83/04

[52] U.S. Cl. ..... 206/531; 206/484; 206/532

[58] Field of Search ..... 206/528, 530–532, 206/538, 539, 484, 484.2, 820, 461–462, 469, 471, 807

[56] References Cited

U.S. PATENT DOCUMENTS

| | | | |
|---|---|---|---|
| Re. 29,705 | 7/1978 | Compere . | |
| 2,968,391 | 1/1961 | Sparks | 206/532 |
| 3,835,995 | 9/1974 | Haines | 206/532 |
| 3,912,082 | 10/1975 | Gerner et al. . | |
| 3,924,746 | 12/1975 | Haines | 206/530 |
| 4,011,949 | 3/1977 | Braber et al. . | |
| 4,125,190 | 11/1978 | Davie, Jr. et al. . | |
| 4,243,144 | 1/1981 | Margulies | 206/820 |
| 4,537,312 | 8/1985 | Intini . | |
| 5,088,603 | 2/1992 | Kirkpatrick . | |
| 5,172,812 | 12/1992 | Wharton et al. . | |
| 5,339,960 | 8/1994 | Price | 206/532 |

*Primary Examiner*—B. Dayoan

*Assistant Examiner*—Luan K. Bui

*Attorney, Agent, or Firm*—Flynn, Thiel, Boutell & Tanis, P.C.

[57] ABSTRACT

PIT WORLD INTELLECTUAL PROPERTY ORGANIZATION International Bureau INTERNATIONAL APPLICATION PUBLISHED UNDER THE PATENT COOPERATION TREATY PCT) (51) International Patent Classification 6: (11) International Publication Number: WO 96/03329 B65D 75/3 Al B65D 75/34 Al (43) International Publication Date: 8 February 1996 (08.02.96) (21) International Application Number: PCT/US95/07863 (81) Designated States: AM, AT, AU, BB, BG, BR, BY, CA, CH, CN, CZ, DE, DK, EE, ES, FI, GB, GE, HU, IS, JP, KE, (22) International Filing Date: 28 June 1995 (28.06.95) KG, KP, KR, KZ, LK, LR, LT, LU, LV, MD, MG, MN, MW, MX, NO, NZ, PL, PT, RO, RU, SD, SE, SG, SI, SK, TJ, TM, TT, UA, US, UZ, VN, European patent (AT, BE, (30) Priority Data: CH, DE, DK, ES, FR, GB, GR, IE, IT, LU, MC, NL, PT, 08/280,496 26 July 1994 (26.07.94) US SE), OAPI patent (BF, BJ, CF, CG, CI, CM, GA, GN, ML, MR, NE, SN, TD, TG), ARIPO patent (KE, MW, SD, SZ, UG). (60) Parent Application or Grant (63) Related by Continuation US 08/280,496 (CON) Published Filed on 26 July 1994 (26.07.94) With international search report. (71) Applicant (for all designated States except US): THE UPJOHN COMPANY (US/US]; 301 Henrietta Street, Kalamazoo, Nl 49001 (US). (72) Inventor; and (75) Inventor/Applicant (for US only): LEBLONG, Wayne, T. (US/US]; 612 Aldersgate, Portage, MI 49002 (US). (74) Agent: ARNER, Raymond, G.; The Upjohn Company, Corporate Intellectual Property Law, 301 Henrietta Street, Kalamazoo, MI 49001 (US). (54) Title: CONVERTIBLE CHILD-RESISTANT BLISTER PACKAGE (57) Abstract A blister package (10) which can be converted from child-resistant to nonchild-resistant at the user's discretion. A slit (21) is provided in each package for enabling access to an individual blister and a section (22) of 2 z the package can be removed to provide access to a tearaway perforated strip for providing access to a row of blisters. Alternatively, a tearaway perforated strip (30) can also be provided for enabling access to an individual blister.

13 Claims, 6 Drawing Sheets

CONVERTIBLE CHILD-RESISTANT BLISTER PACKAGE

This application is a continuation (national phase) of International application No. PCT/US95/07863, International Filing Date 28 Jun. 1995, which was a continuation of U.S. patent application Ser. No. 08/280,496, filed 26 Jul. 1994, now abandoned.

BACKGROUND OF THE INVENTION

In recent years, a great deal of effort has been directed toward providing packaging for pharmaceutical products which contain sufficient impediments to access to the packaged drugs to prevent children from easily opening the package. These "child-resistant" packages also should be able to provide easy access to the packaged drugs to adults who are able to follow the directions for opening the package.

A popular type of child-resistant package currently on the market is the so-called "peel-push" packaging in which tablets are contained in individual flexible blisters of a thermoplastic material and sealed by a rupturable foil material which is in turn covered by a protective layer. Access to the tablets is selectively obtained by peeling off the protective layer to expose a rupturable foil material and pushing the tablet through the rupturable material by pressing on the blister. Examples of this type of packaging are illustrated in FIG. 7 and in U.S. Pat. Nos. 3,912,082, 4,011,949, 4,125,190, 5,088,603, 5,172,812 and U.S. Reissue Pat. No. 29,705.

Another popular type of child-resistant package is illustrated in FIGS. 5 and 6. This packaging 10 is made up of a polyvinyl chloride blister layer 116 having a blister 114 provided therein, a thin foil layer 120, a polyester support layer 122 and a paper bottom layer 124. Perforated lines 104, 106 and 108 separate individual packages 10 from each other and tear slits 110 and 112 are provided in the packages to allow access to the contents of the packages. The packages 10 are generally formed into arrays 102 made up of two or more packages 10.

Although child-resistant packaging has proved to be successful over a period of time in being effective in the prevention of children gaining access to the packaged drug, in environments where children are not present, the child-proof features of the packaging can be undesirable. That is, in hospitals and homes containing only elderly people, ease of access to the packaged pharmaceutical is probably the most important consideration with respect to packaging. Therefore, there is a need for a drug packaging which can be converted from being child-resistant, in which certain prescribed steps must be performed in order to obtain access to the drug, to nonchild-resistant, wherein access to the packaged drug is easily obtained.

SUMMARY OF THE INVENTION

It is, therefore, an important object of the present invention to provide a drug package construction which enables the package to be converted from child-resistant to nonchild-resistant with a minimum amount of effort by the user.

It is a further object of the present invention to provide a drug packaging having child-resistant features which require that specific manipulative steps be performed in order to gain access to an individual dose of medicament and which also contains features which enables the drug packaging to be modified by the user such that easy access to the contents of the drug packaging is afforded.

The above and other objects of the present invention are accomplished by providing a novel blister foil package for containing a solid medicament. This package comprises a first, second, and a third sheet. The first and second sheets are laminated together and have a plurality of blisters for containing a medicament formed therebetween and aligned into rows composed of two or more blisters. The third sheet is laminated to the second sheet at a side opposite to the first sheet. A first access means is provided in the first, second and third sheets for enabling access to only an individual blister and a second access means is provided in the third sheet for providing access to a row of blisters.

DETAILED DESCRIPTION OF THE INVENTION

Figure 1:
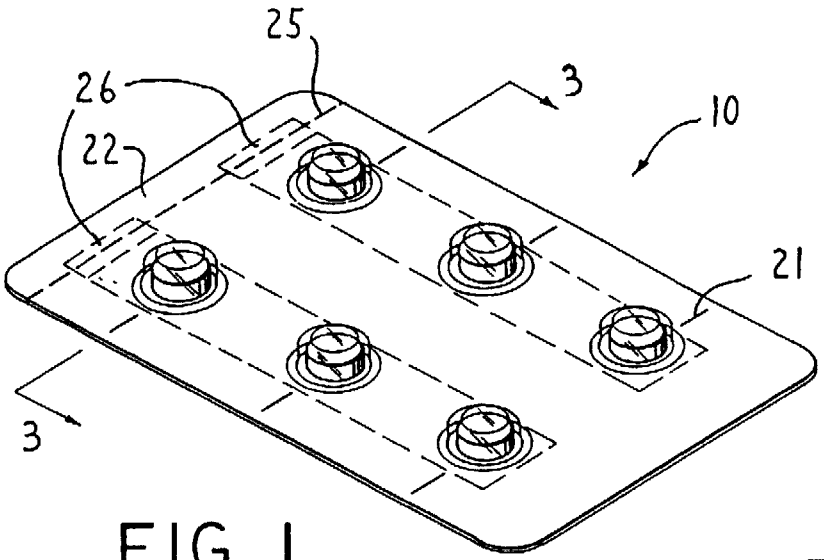
FIG. 1 is a perspective view showing a first embodiment of a convertible child-resistant package of the present invention.

Referring now to FIGS. 1–4, the convertible child-resistant blister package 10 of the present invention is made up of a first thermoformable layer 11 bonded to a second layer 12 made of a rupturable material. The second layer 12 may be coated with a heat seal coating in order to allow the heat sealing of the first layer 11 to the second layer 12. A plurality of deformations or blisters 15 are provided in the first layer 11 and are aligned in rows made up of two or more blisters 15. The blisters 15 are adapted to receive and contain a solid pharmaceutical medicament 16 therein. A third layer 17 is provided under the second layer 12 and serves as a support therefor. The third layer 17 may be coated with a release peel coating on its side in contact with the second layer 12 in order to prevent permanent bonding between these layers and can optionally be backed by a fourth layer 20.

The first layer 11 preferably is made of polyvinyl chloride or a polyvinyl chloride copolymer, such as vinyl chloride/vinyl acetate copolymers (with or without small amounts of interpolymerized acids present), as well as modified polyvinyl chloride and/or laminated polyvinyl chloride materials. The polyvinyl chloride also may be sprayed or laminated with a polyvinylidene chloride coating to improve its moisture resistance. Other suitable materials for the first layer 11 are polyvinylidene chloride, polypropylene, polyethylene, Aclar®, PETG/PP, PETG/HDPE and blends thereof. The first layer 11 typically has a thickness of from 7.5 to about 15 mil.

The second layer 12 is preferably made of aluminum foil and may have a thickness of from 0.8 to 1.0 mil. As discussed above, a heat sealable material, such as a vinyl resin, may be coated on the aluminum foil in order to aid in the heat sealing of the foil layer 12 to the polyvinyl chloride layer 11. A PVC/PVAC copolymer lacquer such as LX4 by Hueck & Cie is especially suitable as the heat seal coating.

The third layer 17 is preferably made of a polyester of about 48 to 100 gauge. Polyethylene terephthalates such as Mylar® by DuPont are especially preferred as the polyester. The third layer 17 is adhered to the second layer 12 in such a manner that the third layer 17 can be peeled from the second layer 12. The adherence of the third layer 17 to the second layer 12 can be accomplished by heat sealing or using a suitable adhesive that does not accomplish permanent bonding. A release peel coating is preferably provided between the second layer 12 and the third layer 17. A one-component polyurethane such as NST7 by Hueck & Cie is suitable as the release peel coating. The fourth layer 20 is provided as a backing layer for the third layer 17 and is preferably made of paper having a weight of from 15 to 30 pounds. If the paper layer 20 is present, it is formed integral with the polyester layer 17 so that they may be removed as a unit.

In a preferred embodiment of the present invention, the second layer 12, third layer 17 and fourth layer 20 are formed into a unitary laminate. A release peel coating is provided between the second layer 12 and the third layer 17 to prevent the permanent bonding of the second layer to the third layer. A heat seal coating applied to the second layer 12 assists in the bonding of the first layer to the unitary laminate of the second, third and fourth layers. Printing can optionally be provided on either side of the second layer 12 and can be used to evidence tampering of the package 10. Product information and/or opening instructions can be provided on the fourth layer.

Figure 2:
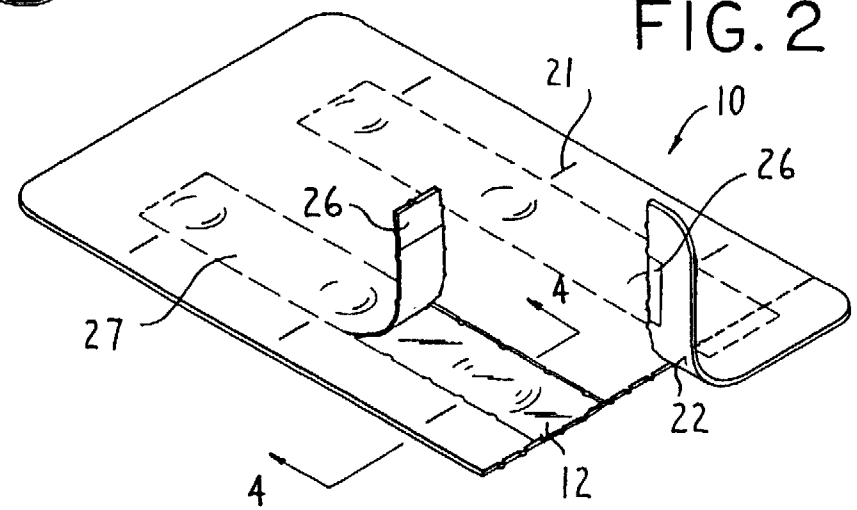
FIG. 2 is a perspective view showing the package of FIG. 1 being converted into nonchild-resistant.
Figure 3:
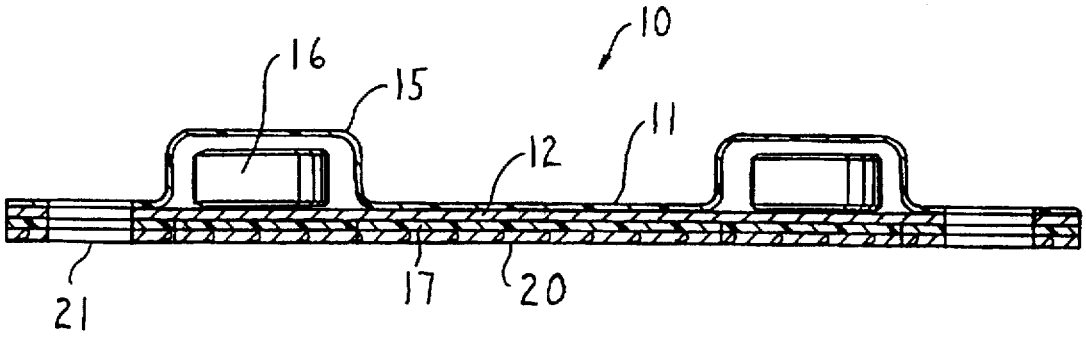
FIG. 3 is a cross-sectional view taken along line 3—3 of FIG. 1.

As shown in FIGS. 1–3, tear slits 21 are provided in the package 10. The tear slits 21 extend through the first, second, third and fourth layers and serve as a means for gaining access to an individual blister 15. The tear slits 21 are preferably straight slits which are oriented so that they are normal to the rows of blisters 15 and are directed at individual blisters 15 such that a straight line drawn along the length of the tear slit 21 would intersect with an individual blister 15. The length of the tear slit 21 is not critical and is determined by the desired degree of difficulty in gaining access to the blister 15. Preferably, the tear slits are provided in the face of the package 10 at a location approximately halfway between the edge of the package and the edge of a longitudinally extending perforated strip 27.

In its "unused" state, the package is "child-resistant" in that access to the contents of the package 10 can only be gained by use of the tear slits 21. In this mode, entry to the contents of the package 10 is gained by the user grasping the package at positions directly adjacent to opposite sides of the tear slit and pulling in opposing perpendicular directions with respect to the plane of the package. A tear then ensues from the edge of the package, through the tear slit 21 and into the blister 15 thereby enabling access to the contents of the blister.

Figure 9:
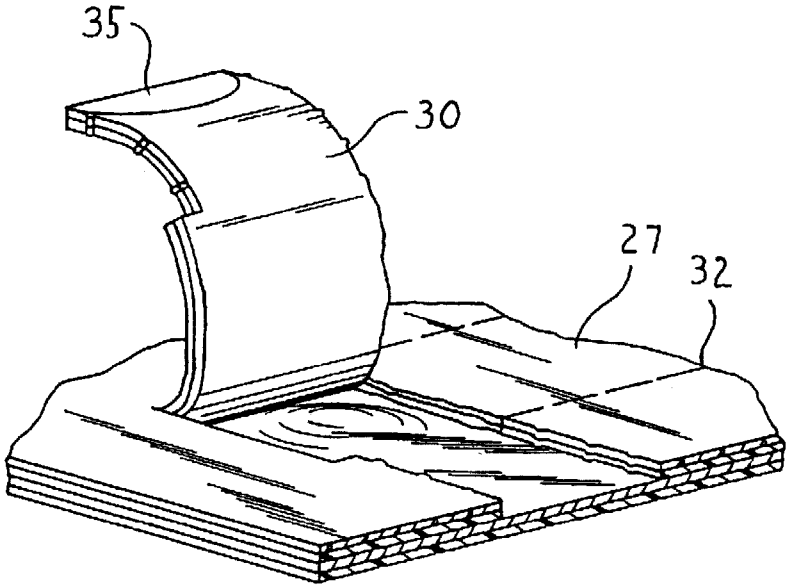
FIG. 9 is a cross-sectional view taken along the line 9—9 of FIG. 8.
Figure 8:
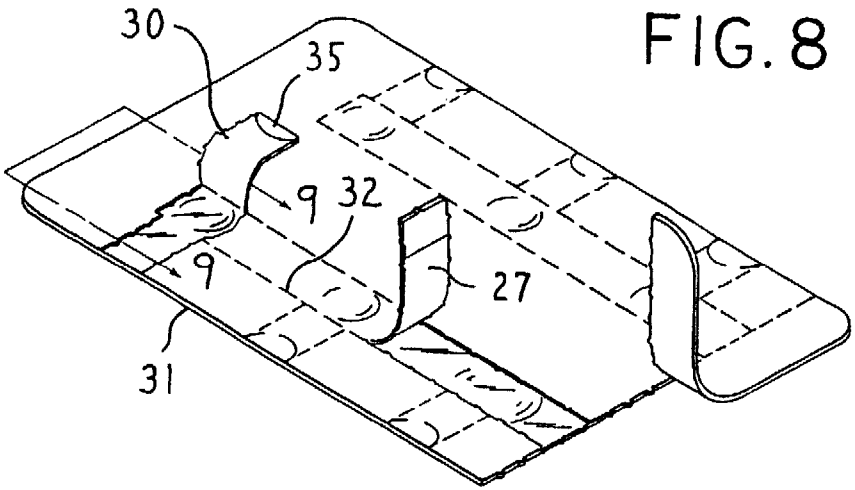
FIG. 8 is a perspective view showing a second embodiment of a child-resistant package of the present invention showing the child-resistant and nonchild-resistant features of the package.

FIGS. 8 and 9 illustrate another embodiment of the present invention where a laterally extending perforated strip 30 serves as the means for gaining access to an individual blister 15. The perforated strip 30 extends laterally from the edge 31 of the package to the outside tear line 32 of the longitudinal perforated strip 27. The lateral perforated strip 30 is also provided in only the third and fourth layers 17, 20. The end 35 of the lateral perforated strip 30 adjacent to the package edge 31 is not sealed to the second layer 12 to enable the user to easily grasp the perforated strip end 35 and commence the peeling of the third and fourth layers 17, 20 from the second layer 12. The lateral perforated strip 30 is peeled inwardly to the outside tear line 32 where a tear then issues to the inside tear line 33 to expose the rupturable second layer 12 underneath an individual blister 15. The medicament 16 contained in the blister 15 is obtained by pushing or collapsing a part of the blister 15 into the medicament which in turn forces the medicament against the rupturable second layer 12 and ruptures the second layer 12 to give the user access to the medicament 16. As shown in FIG. 8, this embodiment of the present invention can be made nonchild-resistant in the same manner as the first embodiment.

Another feature of the present invention is that the package 10 can be made nonchild-resistant. As illustrated in FIG. 1, the package 10 of the present invention has a detachable section 22 provided at an end thereof. The detachable section 22 is oriented normal to the rows of blisters 15 and is separated from the remainder of the package 10 by a line of demarcation 25. The line of demarcation 25 can be a perforated line which extends throughout all of the layers of the package or simply a line printed on the front and/or back side of the package 10 indicating where the detachable section 22 is to be removed from the package. In FIG. 2, in which the package 10 is viewed from this back side, the line of demarcation 25 is a perforated line.

As shown in FIG. 2, the detachable section 22 is removed from the remainder of the package 10 by grasping the package 10 and the detachable section 22 on opposite sides of the perforated line 25 and pulling in opposing perpendicular directions with respect to the plane of the package. A tear would then ensue which separates the detachable section 22 from the remainder of the package 10. Alternatively, the detachable section 22 can be removed from the remainder of the package 10 by cutting the package along the line of demarcation 25.

The removal of the detachable section 22 from the package 10 exposes the end 26 of a longitudinally extending perforated strip 27 provided in the third and fourth layers 17, 20. The perforated strip 27 is provided directly beneath and completely encompasses a row of blisters 15 and extends throughout the length of the row of blisters. The end 26 of the perforated strip is not sealed to the second layer 12 which thereby enables the user to easily grasp the perforated strip end 26 and commence the removal of the perforated strip 27 from the back side of the package 10.

Figure 4:
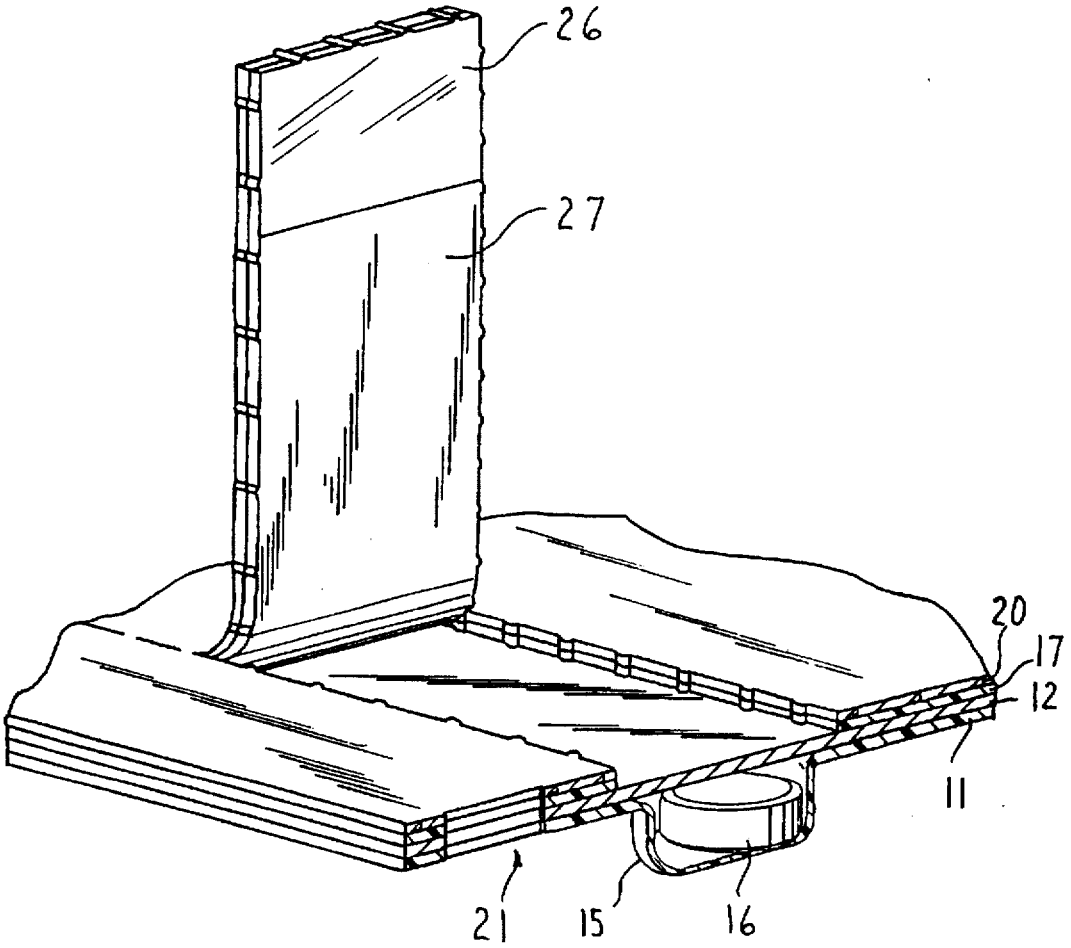
FIG. 4 is a cross-sectional view taken along the line 4—4 of FIG. 2.
Figure 5:
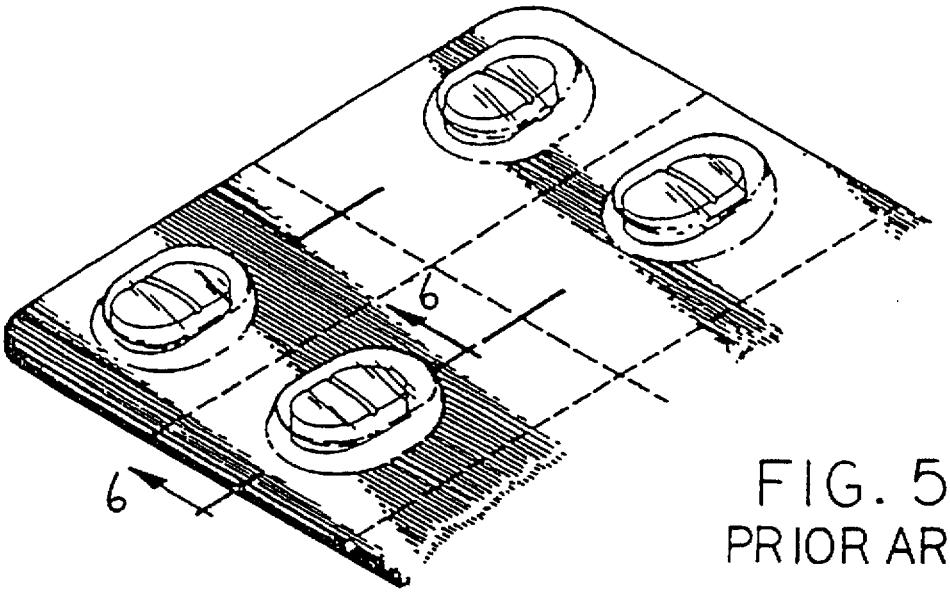
FIG. 5 PRIOR ART
FIG. 5 is a perspective view of a prior art child-resistant package.
Figure 6:
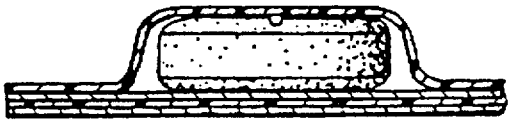
FIG. 6 PRIOR ART
FIG. 6 is a cross-sectional view taken along the line 6—6 of FIG. 5.
Figure 7:
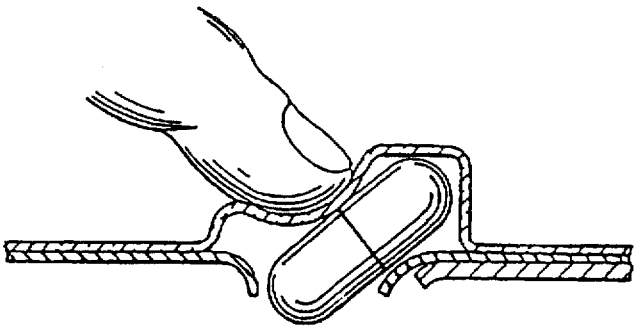
FIG. 7 PRIOR ART
FIG. 7 is a cross-sectional view showing the step of removing a tablet from a prior art package.

As shown in FIGS. 2 and 4, by pulling the perforated strip end 26 along the length of the rows of blisters, the perforated strip 27 separates from the rest of the package 10 and exposes the rupturable second layer 12. When the perforated strip 27 is completely removed from the back side of the package 10, the user is thereby given easy access to an entire row of blisters.

Once the perforated strip 27 has been removed, the medicament 16 contained in the blister 15 is obtained by pushing or collapsing a part of the blister 15 into the medicament 16 which in turn forces the medicament against the rupturable second layer 12 and ruptures the second layer 12 to give the user access to the medicament 16. Although removal of the perforated strip 27 has been described as making the package 10 nonchild-resistant, it is readily apparent this description is only relative with respect to the package's unused state. After the strip 27 has been removed, the user still must possess the knowledge of pressing the blister 15 into the medicament 16 and thereby force the medicament 16 to rupture the second layer 12 and enable access to the medicament. As such, even after removal of the strip 27, the package 10 still affords protection against ready access to children.

It will be apparent to those skilled in the art from the preceding description, that certain changes can be made in the previously discussed package without departing from the scope of the invention. Accordingly, it is intended that the descriptive matter hereinabove shall be interpreted as illustrative and in no way limiting, since all equivalents within the scope of this disclosure may be substituted and such substitution is intended to be embraced in the following claims.

The embodiments of the invention in which an exclusive property or privilege is claimed are defined as follows:

1. A convertible child-resistant package comprising a first sheet, a second sheet and a third sheet, the first and second sheets being laminated together and having a plurality of blisters for containing a medicament defined therebetween, the third sheet being laminated to the second sheet at a side opposite to said first sheet, said blisters being aligned into rows composed of two or more blisters, first access means provided in said first, second and third sheets for enabling access to only an individual blister and second access means provided in said third sheet for providing access to a row of blisters, said second access means comprising a perforated strip provided in said third sheet directly underneath said row of blisters and extending throughout the length thereof and a detachable section provided in said first, second and third sheets oriented normal to said perforated strip and contacting an end thereof.

2. The package of claim 1, wherein said first access means comprises a slit.

3. The package of claim 2, wherein said slit is oriented normal to said rows.

4. The package of claim 1, wherein said second sheet is aluminum foil.

5. The package of claim 1, wherein said first sheet comprises polyvinyl chloride.

6. The package of claim 1, wherein said detachable section is separated from the remainder of the package by perforated lines provided in the first, second and third sheets.

7. The package of claim 1, additionally comprising a fourth sheet laminated to the third sheet at a side opposite to said second sheet.

8. The package of claim 7, wherein said first and second access means are provided in said fourth sheet.

9. The package of claim 1, wherein said third sheet is a polyester sheet.

10. The package of claim 7, wherein said fourth sheet is a paper sheet.

11. The package of claim 1, wherein said first access means comprises a first perforated strip oriented normal to said rows.

12. The package of claim 1, wherein said second access means comprises a second perforated strip, said second perforated strip being provided directly underneath said row of blisters and extending throughout the length thereof.

13. A convertible child-resistant package and medicament combination comprising a first sheet, a second sheet, a third sheet and a fourth sheet, the first and second sheets being laminated together and having a plurality of blisters containing said medicament defined therebetween, the third sheet being laminated to the second sheet at a side opposite to said first sheet and said fourth sheet being laminated to said third sheet at a side opposite to said second sheet, said blisters being aligned into rows composed of two or more blister, first access means comprising a slit provided in said first, second, third and fourth sheets for providing access to only an individual blister and second access means comprising a perforated strip provided in said third and fourth sheets and a detachable section provided in said first, second, third and fourth sheets for providing access to a row of blisters, said perforated strip being provided directly underneath said row of blisters and extending throughout the length thereof and said detachable section being oriented normal to said perforated strip and contacting an end thereof.

* * * * *